US005327198A

United States Patent [19]

Kitagawa et al.

[11] Patent Number: 5,327,198

[45] Date of Patent: Jul. 5, 1994

[54] MOVEMENT HAMPERING DEVICE FOR AN EXPOSURE APPARATUS

[75] Inventors: Shoichi Kitagawa, Neyagawa; Mitsugu Miyamoto, Moriguchi; Daisuke Hayashi, Hirakata; Hideki Ishida, Yao; Hiroshi Kusumoto, Wakayama, all of Japan

[73] Assignee: Mita Industrial Co., Ltd., Osaka, Japan

[21] Appl. No.: 966,457

[22] Filed: Oct. 26, 1992

[30] Foreign Application Priority Data

Nov. 20, 1991 [JP] Japan ..... 3-329610

[51] Int. Cl.[5] ..... G03G 15/28

[52] U.S. Cl. ..... 355/236; 355/67

[58] Field of Search ..... 355/232, 233, 235, 236, 355/45, 58, 67

[56] References Cited

U.S. PATENT DOCUMENTS

| | | | |
|---|---|---|---|
| 4,073,584 | 2/1978 | Kitajima | 355/235 |
| 4,256,399 | 3/1981 | Ikeda | 355/235 |
| 4,367,945 | 1/1983 | Abe | 355/235 X |
| 4,386,842 | 6/1983 | Beery | 355/235 |
| 4,403,877 | 9/1983 | Jones et al. | 355/236 X |
| 4,500,197 | 2/1985 | Dannatt | 355/235 |
| 4,603,963 | 8/1986 | Hinton et al. | 355/235 |
| 4,634,261 | 1/1987 | Nagoshi | 355/233 |
| 4,636,058 | 1/1987 | Fujii | 355/233 |
| 4,649,437 | 3/1987 | Watanabe | 355/235 X |
| 4,728,988 | 3/1988 | Tsutsui et al. | 355/235 |
| 4,862,218 | 8/1989 | Tsunoda et al. | 355/233 X |
| 4,891,669 | 1/1990 | Hiroki | 355/235 |
| 5,002,366 | 3/1991 | Okazaki | 355/233 X |
| 5,097,290 | 3/1992 | Watanabe | 355/235 X |
| 5,191,377 | 3/1993 | Kagiura et al. | 355/235 |

*Primary Examiner*—A. T. Grimley
*Assistant Examiner*—Shuk Y. Lee
*Attorney, Agent, or Firm*—Beveridge, DeGrandi, Weilacher & Young

[57] ABSTRACT

The exposure apparatus is provided with a first mirror frame movement hampering means for hampering the movement of the first mirror frame in the exposing direction. The first mirror frame movement hampering means has a closure mounted on an operating opening on the main body and a movement hampering member mounted on the closure and positioned near a linking portion of the driving device of the first mirror frame and at a position at which the movement in the exposing direction is interfered. The movement hampering member is mounted on the closure to adjust its position freely within a predetermined range in the reciprocatingly moving direction of the first mirror frame.

5 Claims, 5 Drawing Sheets

A
2
4
6
8
10
12
14
16
18
20
22
24
26
28
30
32
34
36
38
40
42
43
44
45
46
47
48
49
50
52
Y

MOVEMENT HAMPERING DEVICE FOR AN EXPOSURE APPARATUS

FIELD OF THE INVENTION

This invention relates to an exposure apparatus to be applied to an image-forming machine such as an electrostatic copying machine or an electrostatic printer.

DESCRIPTION OF THE PRIOR ART

As an exposure apparatus to be provided in an image-forming machine such as an electrostatic copying machine, a so-called optical system moving type, or more specifically, a mirror moving type, is known. A prior example of this exposure apparatus is comprised of movable members, i.e., a first mirror frame and a second mirror frame, supported reciprocatingly movably on the main body of the image-forming machine and an optical system driving device which is connected to the first mirror frame and the second mirror frame and allows to reciprocatingly move the first mirror frame at a speed twice the speed of the second mirror frame. A light source and a first mirror are provided on the first mirror frame, and second and third mirrors are provided on the second mirror frame. Reflected light from a document surface placed on a transparent glass is successively reflected by the mirrors provided on the first mirror frame and the second mirror frame, passes through an image-forming lens, and then by a fourth mirror, is reflected and projected on the surface of a photosensitive drum.

In .the above exposure apparatus, an operation of adjusting a light path length and of fixing the movable members (hampering of movement) are carried out in advance of shipping of the image-forming machine. The fixation of the movable members is effected to prevent deformation and breakage of an optical system containing movable members during transportation of an image-forming machine. An example in the prior art of an exposure apparatus equipped with a fixation mechanism for fixing a movable member may be one disclosed in Japanese Laid-Open Utility Model Publication No. 19962/1989. In the exposure apparatus disclosed in the above Publication, an operating opening for adjusting a position at which a first mirror frame is linked to a driving device (hereinafter referred to as a linking position with respect to a driving device) of a first mirror frame is provided in the main body of the image-forming machine. The operating opening is provided with a closure. An engageable movement hampering member (mirror frame fixing member) is secured near the linking portion with respect to the optical system driving device of the first mirror frame in this closure. The adjustment of the light path length is carried out by adjusting the linking position with respect to the driving device of the first mirror frame by utilizing the operating opening. Then, by mounting the closure on the operating opening, the movement hampering member is positioned at a position where it interferes with the movement of the linking portion with respect to the optical system driving device of the first mirror frame. This hampers the movement of the first mirror frame and fixes the exposure apparatus at a predetermined position.

The above-described prior exposure apparatus has the following problems to be solved. Generally, in the light path length from the upper surface of the transparent glass to the surface of the photosensitive drum surface, predetermined errors may arise between the designed values and the product manufactured due to the focal length tolerance (variations of the focal length) or a manufacturer's error. On the other hand, since the movement hampering member is integrally mounted on the closure, mounting the closure on the operating opening results in determining its position. Hence, the designing of the operating opening, the closure and the movement hampering member is carried out upon consideration of the above errors. Thus, when the closure is actually mounted on the operating opening, a space due to the above variations in the focal length of the image-forming lens is formed between the movement hampering member and the linking portion with respect to the driving device of the first mirror frame.

In some types of the optical system driving device, one end of its wire is secured to the main body side of the image-forming machine and the other end to the main body side of the image-forming machine via a tension spring (coil spring) to give a tension to the wire. In the exposure apparatus containing this type of driving device, when a space is formed between the movement hampering member and the linking portion with respect to the driving device of the first mirror frame, an impact in the moving direction (exposing direction) of the first mirror frame causes the first mirror frame to move instantaneously by the space against the tension of the tension spring. The wire is wound up on a wire drum linked to a driving motor, and is difficult to rotate due to the load of the driving motor. For this reason, the above-mentioned movement causes the wire to become flexed, and the wire may get out of the wire drum. When the wire gets out of the wire drum, it does not function as an image-forming machine. Furthermore, there will be no restriction on the first mirror frame and the second mirror frame in the moving direction, and the exposing apparatus may be deformed or broken. In order to minimize this space, the accuracies of the individual parts must be maintained at a high level more than necessary, and the cost of production of the entire apparatus becomes extremely high.

SUMMARY OF THE INVENTION

It is a primary object of this invention, therefore, to provide an improved exposure apparatus in which a space between a movement hampering member and a linking portion with respect to an optical system driving device of the first mirror frame, which arises due to the variations in the focal distance of the image-forming lens, can be adjusted to substantially zero.

In order to achieve the above object of the invention, the present invention provides an exposure apparatus comprising a first mirror frame and a second mirror frame supported reciprocatingly movably on the main body of an image-forming machine, an optical system driving device linked to the first mirror frame for the second mirror frame and reciprocatingly moving the first mirror frame at a speed twice the speed of the second mirror frame, an operating opening formed in the main body for adjusting the linking position with respect to the optical system driving device of the first mirror frame, and a first mirror frame movement hampering member for hampering the movement of the first mirror frame in the exposing direction; wherein the first mirror frame movement hampering means is comprised of a closure detachably provided in the operating opening, and a movement hampering member mounted on the closure and near the linking portion with respect to the driving device of the first mirror frame and capable of being positioned at a position at which it interferes with the first mirror frame in movement to the exposing direction, and the movement hampering member is so mounted on the closure that its position is freely adjustable in a predetermined range in the reciprocatingly moving direction of the first mirror frame.

The other objects of this invention will become apparent from the description given later on in detail, by referring to the accompanying drawings, with respect to the example of the exposure apparatus constructed in accordance with this invention.

BRIEF DESCRIPTION OF THE DRAWINGS

FIG. 9 is a plain view of the first mirror frame movement hampering means shown in FIG. 7.

DETAILED DESCRIPTION OF PREFERRED EMBODIMENT

Figure 1:
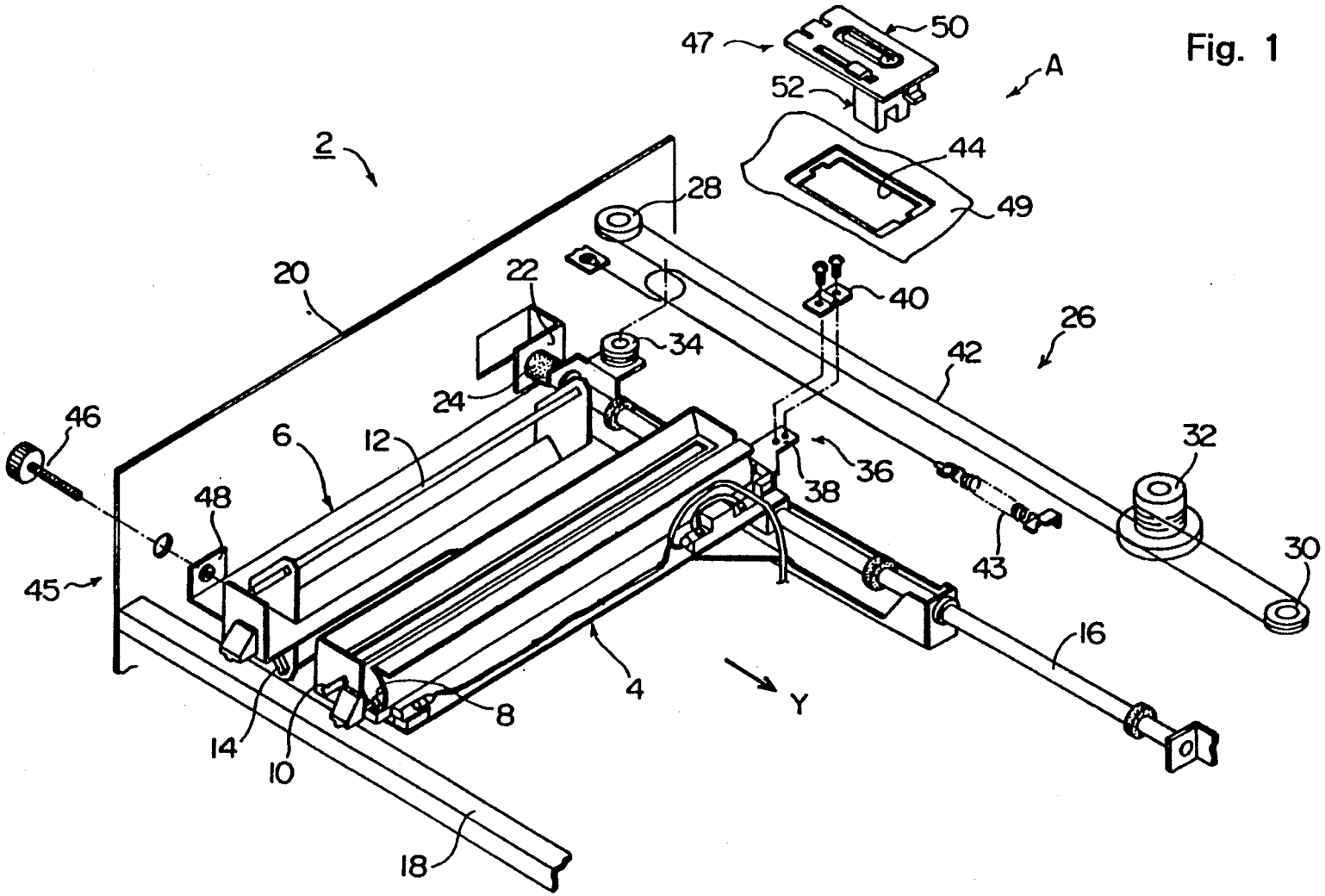
FIG. 1 is a perspective schematic view showing one example of the improved exposure apparatus constructed in accordance with this invention.

With reference to the accompanying drawings, the exposure apparatus improved in accordance with this invention will be described in detail on the basis of the example. In FIG. 1, the exposure apparatus shown generally at 2 is equipped with a first mirror frame 4 and a second mirror frame 6. The first mirror frame 4 is provided with a light source 8 and a first mirror 10. The second mirror frame 6 is provided with a second mirror 12 and a third mirror 14. The first mirror frame 4 and the second mirror frame 6 are supported reciprocatingly movably on the main body of an image-forming machine. More specifically, a supporting guide means is provided in the main body of the image-forming machine. The supporting guide means includes a guide shaft 16 and a guide rail 18. One end of each of the guide shaft 16 and the guide rail 18 is fixed to a side plate 20 constituting one side portion of the main body of the image-forming machine, and the other end of each of the members 16 and 18 is fixed to a side plate (not shown) constituting the other side part of the main body of the image-forming machine. One side portion of each of the first mirror frame 4 and the second mirror frame 6 is fitted and supported reciprocatingly movably on the guide shaft 16, and the other side portion is supported reciprocatingly movably on the guide rail 18. One end of the guide shaft 16 is fixed and supported onto a supporting plate 22 formed by cutting out the side plate 20 in an L-shape. A cylindrical dumper 24 is inserted and supported on the above end portion of the guide shaft 16. The dumper 24 is formed from an urethane foam, and the second mirror frame 6 is made stationary by abutting it on the dumper 24 at the final step of the exposing operation.

The exposing apparatus 2 further is provided with an optical system driving device 26. The driving device 26 is coupled to the first mirror frame 4 and the second mirror frame 6 and reciprocatingly moves the first mirror frame 4 at a speed twice the speed of the second mirror frame 6. At a side position of the guide shaft 16, wire pulleys 28 and 30 are arranged at the side plate 20 and another side plate (not shown). Between the wire pulleys 28 and 30, a wire drum 32 is provided near the wire pulley 30. The wire drum 32 is linked to a driving motor not shown. On one side position of the second mirror frame 6, a second mirror frame pulley 34 is supported. At one side position of the first mirror frame 4, a linking portion 36 with respect to the driving device 26 of the first mirror frame 4 is provided. The linking portion 36 is composed of a flange portion 38 projecting horizontally outwardly of one side portion of the first mirror frame 4 and a wire holding member 40 fixed detachably by means of a screw on the flange portion 38. A wire 42 with one end fixed to the main body near the side plate 20 is wound up on a second mirror frame pulley 34, inverted and wound up on the wire pulley 28, inverted and wound up on the wire drum 32, and wound up on the wire pulley 30. A wire 42 wound up on the wire pulley 30 is inverted and wound up on the second mirror frame pulley 34, is inverted and extends in the direction of the other side plate, and then near the position of the wire drum 32, its other end is fixed to the main body via a coil spring 43 which is a tension spring. By normally rotating or inversely rotating the wire drum 32 by a driving motor, the first mirror frame 4, via the linking portion 36, and the second mirror frame 6, via the second mirror frame pulley 34, are moved reciprocatingly along the guide shaft 16 and the guide rail 18.

At an upper surface portion 49 (ceiling portion) of the main body of the image-forming machine, an operating opening 44 for adjusting the linking position with respect to the driving device 26 of the first mirror frame 4 is provided. The operating opening 44 is approximately rectangular, and is provided above the upper position of the linking portion 36 when the first mirror frame 4 is at a home position. The light path length is adjusted by adjusting the position of the first mirror frame 4 by utilizing the operating opening 44. After adjusting the light path length, the wire 42 is fixed above the flange portion 38 of the first mirror frame 4 by means of the wire holding member 40. Accordingly, the first mirror frame 4 is linked to the driving device 26 at the linking portion 36.

The exposure apparatus 2 is equipped with a second mirror frame movement hampering means 45 for hampering the movement of the second mirror frame 6 and a first mirror frame movement hampering means 47 for hampering the movement of the first mirror frame 4 in the exposing direction (Y direction shown by an arrow in FIG. 1). The second mirror frame movement hampering means 45 includes a locking bolt 46 for fixing detachably one end portion of the second mirror frame 6 to the side plate 20 of the main body of the image-forming machine positioned on the home position side of the second mirror frame 6. The screwing of the locking bolt 46 can be done from outside the side plate 20. An upright flange portion 48 is formed at one end part of the second mirror frame 6. A threaded hole is formed in the upright flange portion 48. A securing hole is formed in the side plate 20 coaxially with the threaded hole. When the second mirror frame 6 is fixed at the home position, the locking bolt 46 is screwed into the threaded hole of the upright flange portion 48 via the securing hole of the side plate 20. Thus, the second mirror frame 6 is fixed to the side plate 20.

The first mirror frame movement hampering means 47 is composed of a closure 50 detachably provided in the operating opening 44 and a movement hampering member 52 mounted on the closure 50 and provided near the linking portion 36 with regard to the driving device 26 of the first mirror frame 4 and positioned at a position at which it interferes with the movement of the first mirror frame 4 in the exposing direction. The closure 50 and the movement hampering member 52 are made from a synthetic resin such as an ABS resin. The movement hampering member 52 is mounted on the closure 50 position-adjustably within a predetermined range in the reciprocably moving direction of the first mirror frame 4. Hereinbelow, the first mirror frame movement hampering means will be specifically illustrated.

Figure 2:
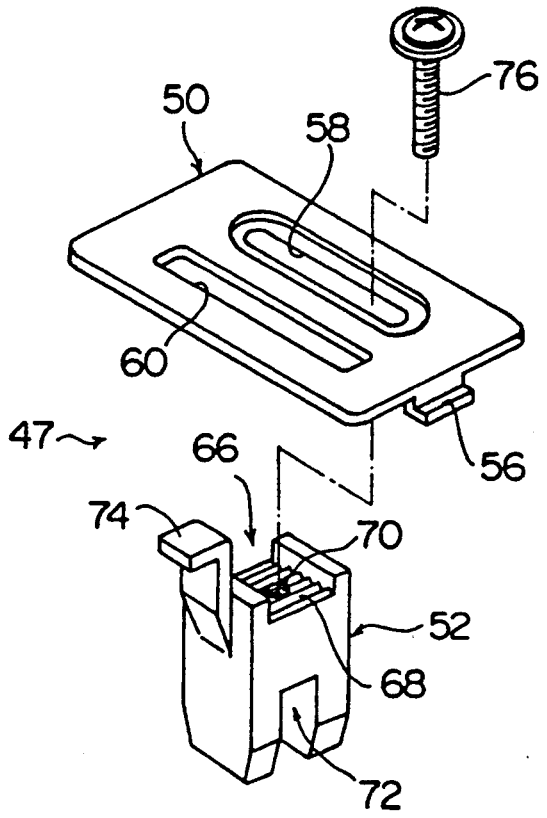
FIG. 2 is an exploded perspective view showing a first mirror frame movement hampering means.
Figure 3:
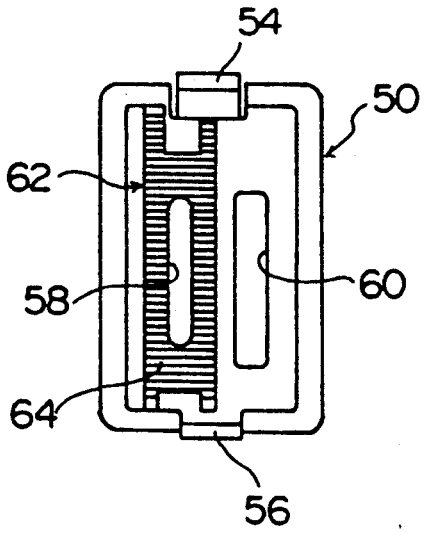
FIG. 3 is a view showing a closure constituting part of the first mirror frame movement hampering means of FIG. 2, seen from an underside.
Figure 4:
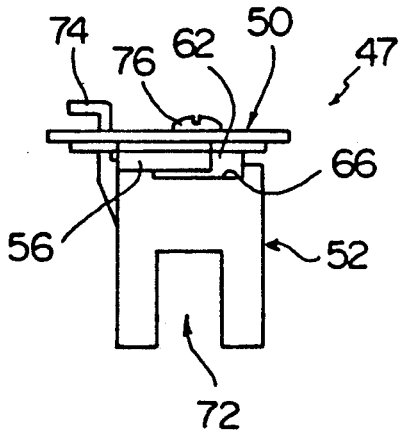
FIG. 4 is a side view when
Figure 5:
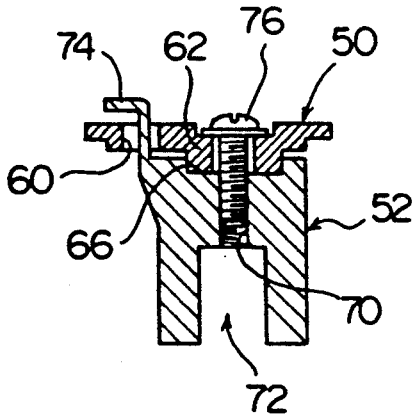
FIG. 5 is a C—C arrow sectional view of FIG. 9.
Figure 6:
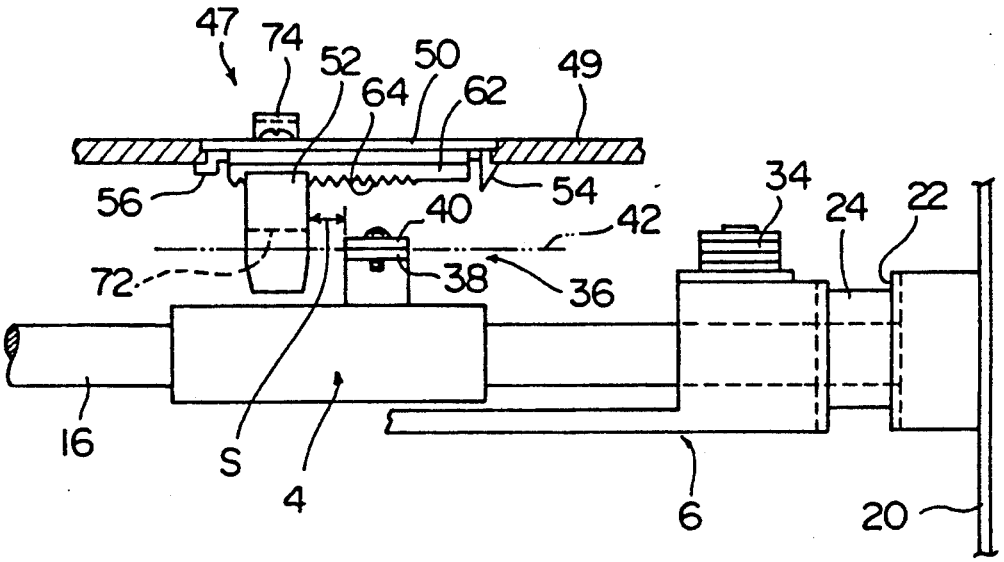
FIG. 6 is a schematic view showing a positional relationship of a first mirror frame movement hampering means and a first mirror frame, namely a view resulting from seeing FIG. 1 from the A direction.
Figure 7:
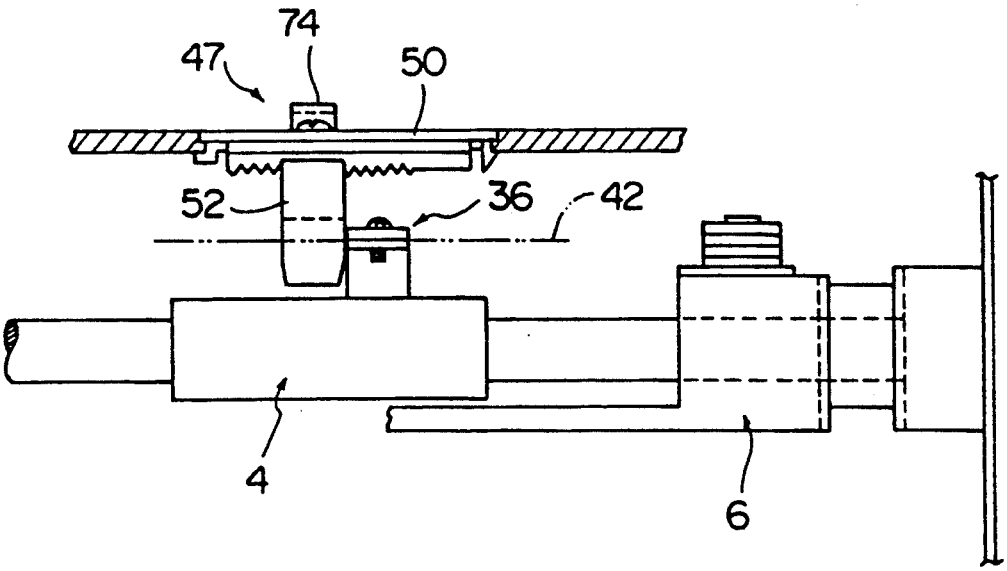
FIG. 7 is a view showing another operating embodiment of FIG. 6.

With reference to FIG. 2 and to FIG. 5, a hooklike engaging nail 54 and an engaging piece 56 that enable the closure 50 to be detachably mounted on the operating opening 44 are provided on both end portions of the rectangular closure 50 (also see FIGS. 6 and 7). A pair of guide holes 58 and 60 are spaced from each other and formed in parallel in a predetermined direction in the main body portion of the closure 50. Under the lower surface of the closure 50, an engaging projecting portion 62 having a predetermined width and a predetermined thickness is provided so as to extend in the same direction as the guide holes 58 and 60. The guide hole 58 extends within a predetermined range along the central portion in the widthwise direction of the engaging projecting portion 62. In the lower surface of the engaging projecting portion 62, a plurality of positioning teeth 64 are formed in its longitudinal direction over a predetermined range. The teeth 64 are like saw blades as shown in FIGS. 6 and 7.

An engaging groove 66 fittable to the engaging projecting portion 62 and movable along it is formed in the top portion of the main body of the movement hampering member 52 so that it passes from one side to the other. At the bottom portion of the engaging groove 66, a plurality of positioning teeth 68 capable of engaging with the teeth 64 of the engaging projecting portion 62 are formed. A threaded hole 70 is formed at the central portion in the engaging groove 66. Centrally in the bottom portion of the main body of the movement hampering member 52, a concave portion 72 that passes through one side to the other is formed. At an upper position of another side of the top portion, an operating piece 74, extending from a side to upwardly of the engaging groove 66, with an upper end bend is provided integrally.

When the engaging groove 66 of the movement hampering member 52 is fitted in the engaging projecting portion 62 of the closure 50, a mounting screw 76 goes through the guide 58 from upwardly of the closure 50 and is engaged with the threaded hole 70 of the engaging groove 66. At the same time, the operating piece 74 goes through the guide hole 60 and is positioned upwardly thereof. By the above construction, the movement hampering member 52 is mounted on the closure 50 movably in a predetermined direction. By clamping the screw 76, the teeth 68 of the engaging groove 66 are engaged with the teeth 64 of the corresponding engaging projecting portion 62 to fix the movement hampering member 52 at a predetermined position of the closure 50.

Figure 8:
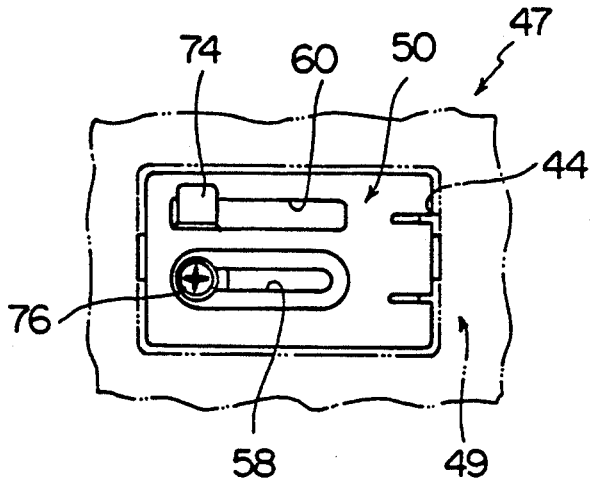
FIG. 8 is a plain view of the first mirror frame movement hampering means shown in FIG. 6.
Figure 9:
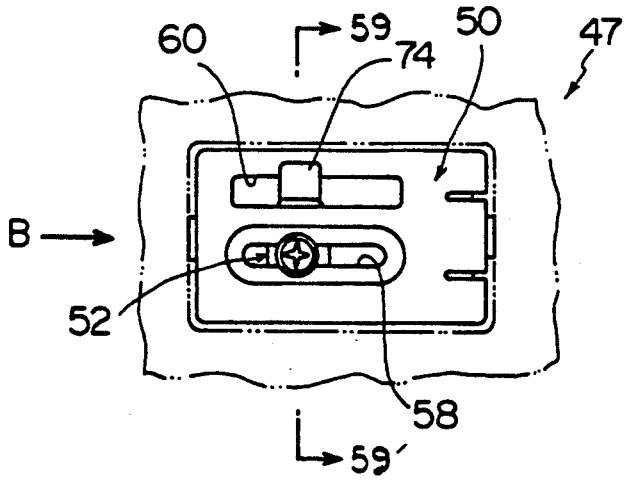
FIG. 9 is seen from the B direction.

In the state where the movement hampering member 52 is secured in the above manner, the closure 50 is mounted on the operating opening 44. Each guide hole 58 and guide hole 60 of the closure 50 are positioned in a direction identical with the reciprocatingly moving direction of the first mirror frame 4 and the second mirror frame 6. In this securing state, the wire 42 is positioned so as to pass through the concave portion 72 of the movement hampering member 52 to avoid mutual interference. With reference to FIGS. 6 and 8, the initial securing position of the movement hampering member 52 of the closure 50 is set so that the screw 76 is positioned at one end portion (the end portion of the first mirror frame 4 in the exposing direction side) of the guide hole 58. Namely, the movement hampering member 52 is set at a position at which the tolerance of the focal length of the image-forming lens is assumed to be a maximum value (the position at which the light path length becomes maximum). As a result, when the closure 50 is mounted on the operating opening 44, a space S is formed between the movement hampering member 52 and the linking portion 36 where the first mirror frame 4 is linked to the wire 42, specifically between the flange portion 38 and one side end of the wire holding member 40, as shown in FIG. 6. In the state shown in FIG. 8, the operating piece 74 is picked from above the closure 50 and the screw 76 is loosened. When the teeth 68 of the movement hampering member 52 get out of the teeth 64 of the closure 50, the movement hampering member 52 is moved, by utilizing the operating piece 74, in the direction opposite to the exposing direction (in the right in FIG. 6) along the guide holes 58 and 60. As shown in FIGS. 7 and 9, when the end portion of the movement hampering member 52 abuts against one end portion of the flange portion 38 and the wire holding member 40 and it cannot further move, the screw 76 is clamped. In the condition where the space S between the movement hampering member 52 and the linking portion 36 linking the first mirror frame 4 to the wire 42 is zero, the position of the movement hampering member 52 is fixed to the closure 50.

With reference to FIGS. 1 and 7, when an impact is exerted on the first mirror frame 4 in the exposing direction during the transportion of the image forming machine, this load is absorbed between the linking portion 36 of the first mirror frame 4 and the end portion of the movement hampering member 52 which abuts against it. Hence, the force of pulling the coil spring 43 does not act on the wire 42. When an impact is exerted on the first mirror frame 4 in the direction opposite to the exposing direction, it is received securely by the fixed end of the wire 42. As mentioned above, since the second mirror frame 6 is also fixed by a locking bolt to the side plate 20, an impact in any direction does not affect the wire 42, or the like.

This invention has been explained in detail on the basis of the example. But this invention is not limited to the above example, hut may be altered or modified optionally within the scope of the invention.

The following effects can be achieved by the present invention illustrated by the above example.

(1) Since the movement hampering member is mounted on a closure detachably mounted on an operating opening formed in the main body of the image-forming machine with its position adjustably within a predetermined range in the reciprocating direction of the first mirror frame, a space between the movement hampering member and the linking portion with respect to the driving device of the first mirror frame, which arises owing to the variations of the focal length of the image-forming lens, can be adjusted to substantially zero. As a result, even when an impact is exerted in the exposing direction of the first mirror frame during transportation, the movement of the first mirror frame is reliably hampered. Consequently, the exposure apparatus is prevented from deformation or breakage. Furthermore, in an exposure apparatus containing a driving device of the type in which one end of the wire of the driving apparatus is fixed to the main body side of the image-forming machine and its other end is secured to the main body side of the image-forming machine via a tension spring (coil spring), the wire is prevented from being released from the wire drum by the above impact, and safety at the time of transportation can be secured.

(2) When the second mirror frame movement hampering means for hampering the movement of the second mirror frame is provided, even if the above impact is exerted on the second mirror frame, a load by the impact is not given at all to the driving apparatus via the wire. Hence, the reliability of the driving device containing the wire is increased.

(3) A pair of guide holes spaced from each other are parallel in a predetermined direction in the closure, the movement hampering member can move along the guide hole and is detachably mounted by the screw going through one of the guide holes, and the movement hampering member has an operating piece extending upwardly from its side portion. When the operating piece is so constructed that it is positioned, through the other guide hole, upwardly thereof movably therealong, the position of the movement hampering member can be very easily adjusted in the state in which the closure is closed.

(4) At the undersurface of the engaging projecting portion provided on the undersurface of the closure, a plurality of positioning teeth are formed. At the top portion of the movement hampering member, an engaging groove capable of movably fitting to the engaging projecting portion in the predetermined direction is formed so that it passed from one side to the other side. When a plurality of positioning teeth capable of being engaged with the teeth of the movement hampering member are formed in the bottom portion of the engaging groove, the movement hampering member is mounted reliably owing to each tooth engaged with each other. Accordingly, even if the above-mentioned impact force acts on the movement hampering member, it can be stably received.

What we claim is:

1. An exposure apparatus comprising:

a first mirror frame a second mirror frame, the mirror frames being supported so as to be reciprocatingly movable on a main body of an image-forming machine, an optical system driving device linked to the first mirror frame at a linking portion and linked to the second mirror frame for reciprocatingly moving the first mirror frame at a speed that is twice a speed of movement of the second mirror frame, means providing an operating opening in the main body for adjusting a linking position of the first mirror frame with respect to the optical system driving device, and a first mirror frame movement hampering device for hampering movement of the first mirror frame in an exposing direction, the first mirror frame movement hampering device including a closure detachably provided in the operating opening, and a movement hampering member mounted on the closure near the linking portion and capable of being positioned at a position at which the movement hampering member interferes with movement of the first mirror frame in the exposing direction, the movement hampering member being so mounted on the closure that the position of the movement hampering member is freely adjustable in a predetermined range in the reciprocating moving direction of the first mirror frame.

2. The exposure apparatus of claim 1 wherein a second mirror frame movement hampering device for hampering the movement of the second mirror frame is provided, the second mirror frame movement hampering device including a locking bolt, detachably mounted, for fixing one end portion of the second mirror frame to a side plate of the main body of the image forming machine located on a home position side of the second mirror frame, such that fastening of the locking bolt can be done from outside the side plate.

3. The exposure apparatus of claim 1 wherein the closure has first and second guide holes that are spaced parallel to each other along a predetermined direction, the movement hampering member is mounted detachably and movably along the first guide hole by a screw which passes through the first guide hole, an operating piece extending upwardly from a side of the movement hampering member is formed on the movement hampering member, and the operating piece is constructed so that the operating piece passes through the second guide hole, the operating piece being movable along the second guide hole, and a portion of the operating piece being positioned above the second guide hole relative to the movement hampering member.

4. The exposure apparatus of claim 3 wherein an engaging projection portion having a predetermined width and a predetermined thickness is so provided on an undersurface of the closure that the engaging projecting portion extends in the predetermined direction, the first guide hole being formed to extend within a predetermined range along a central portion in the width direction of the engaging projecting portion, and a plurality of positioning teeth being formed on an undersurface of the engaging projecting portion along a predetermined range in a longitudinal direction thereof, a top portion of the movement hampering member has an engaging groove, the engaging groove being movable in the predetermined direction of the engaging projecting portion and fittable thereto, the engaging groove being so formed that, passing from a first side of the engaging groove to a second side of the engaging groove, at a bottom portion of the engaging groove, are a plurality of positioning teeth capable of being engaged with the teeth of the engaging projecting portion, and in a central portion of the engaging projecting portion is a threaded hole engageable with the screw such that, when the screw is screwed forward, the teeth of the engaging groove are engaged with the teeth of the corresponding engaging projecting portion, so that the movement hampering member is fixed in a predetermined position of the closure.

5. The exposure apparatus of claim 1 wherein the closure has first and second guide holes that are spaced from each other and are in parallel to each other in a predetermined direction, an engaging projecting portion having a predetermined width and a predetermined thickness is provided in an undersurface of the closure to extend in the predetermined direction, the first guide hole is formed within a predetermined range in a widthwise direction along a central portion of the engaging projecting portion, an undersurface of the engaging projecting portion has a plurality of positioning teeth that extend over a predetermined range in a longitudinal direction of the engaging projecting portion, a top portion of the main body of the movement hampering member has an engaging groove capable of being fitted, movably in the predetermined direction, to the engaging projecting portion, the engaging groove having a plurality of positioning teeth capable of being engaged with the teeth of the engaging projecting portion formed in a bottom portion of the engaging groove, a screw hole is formed in the engaging groove at a central portion of the engaging groove, a convex portion passing from one side of the movement hampering member to another side of the movement hampering member is formed centrally in a bottom portion of the movement hampering member, and an operating piece is provided extending from a side of the movement hampering member upwardly of the engaging groove with its upward end bent such that when the engaging groove of the movement hampering member is fitted to the engaging projecting portion of the closure, a mounting screw passes through the first guide hole to engage the screw hole of the engaging groove, and the operating piece passes through the second guide hole and a portion of the operating piece is positioned above the guide hole with respect to the movement hampering member, such that, when the mounting screw is unscrewed, the movement hampering member is movably mounted on the closure in the predetermined direction, and when the mounting screw is fastened, the teeth of the engaging groove are engaged with the teeth of the corresponding engaging projecting portion to immovably mount the movement hampering member at a predetermined position of the closure.

* * * * *